United States Patent [19]

Tsai et al.

[11] Patent Number: 4,655,947

[45] Date of Patent: Apr. 7, 1987

[54] METALWORKING WITH A TRIMETHYLOLALKANE ESTER LUBRICANT

[75] Inventors: Mei-Yuan Tsai; Joseph T. Laemmle, both of Murrysville, Pa.

[73] Assignee: Aluminum Company of America, Pittsburgh, Pa.

[21] Appl. No.: 888,488

[22] Filed: Jul. 23, 1986

[51] Int. Cl.[4] ..... C10M 173/00; C10M 129/70

[52] U.S. Cl. ..... 252/49.5; 252/56 R; 72/42

[58] Field of Search ..... 252/49.5, 56 R; 72/42

[56] References Cited

U.S. PATENT DOCUMENTS 2,991,297 7/1961 Cooley et al. ..... 260/410.6
3,923,671 12/1975 Knepp ..... 252/56 R
4,061,581 12/1977 Leleu et al. ..... 252/32.7
4,401,580 8/1983 Frost ..... 252/56 R
4,517,105 5/1985 Laemmle et al. ..... 252/56 R
4,585,565 4/1986 Mei-Yuan Tsai ..... 252/56 R

*Primary Examiner*—Jacqueline V. Howard
*Attorney, Agent, or Firm*—Glenn E. Klepac

[57] ABSTRACT

A metalworking lubricant composition comprising mineral oil and a trimethylolalkane ester. A metalworking lubricant emulsion is prepared by mixing about 1–5 wt % of the composition with about 95–99 wt % water. A preferred lubricant composition exhibits an unusual combination of lower wear than prior art compositions along with higher friction when tested on aluminum alloy samples. Accordingly, the lubricant composition is suitable for hot rolling or cold rolling aluminum and aluminum alloys.

20 Claims, No Drawings

METALWORKING WITH A TRIMETHYLOLALKANE ESTER LUBRICANT

BACKGROUND OF THE INVENTION

The present invention relates to metalworking lubricant compositions and methods for their utilization. More particularly, the invention relates to a lubricant composition comprising a trimethylolalkane ester having particular properties that are especially suitable for hot rolling and cold rolling aluminum and aluminum alloys.

Trimethylolalkane esters are known in the prior art. For example, Cooley et al U.S. Pat. No. 2,991,297 discloses the preparation of synthetic lubricants by reacting polyols with acids having chain lengths of 2 to 18 carbon atoms. One suitable polyol is trimethylolpropane.

Leleu et al U.S. Pat. No. 4,061,581 discloses trimethylolpropane total esters as lubricant bases in automobile engines. The lubricants are mixtures of esters which can be made with a high proportion of straight chain monocarboxylic acids having about 2 to 30 carbon atoms.

Although some trimethylolalkane esters are known in the prior art, before the present invention it has not been recognized that lubricant compositions containing certain trimethylolalkane esters possess friction and wear-modifiying properties making such compositions particularly suitable for use in hot rolling and cold rolling aluminum and aluminum alloys.

It is a principal objective of the present invention to provide an improved lubricant composition and emulsion that are suitable for hot rolling and cold rolling aluminum and aluminum alloys.

A related objective of the invention is to provide a method of metalworking utilizing the improved lubricant composition and emulsion.

Additional objects and advantages will become apparent to persons skilled in the art from the following detailed description.

SUMMARY OF THE INVENTION

In accordance with the present invention, there is provided a metalworking lubricant composition comprising mineral oil and a trimethylolalkane ester having the formula $CH_3(CH_2)_nC(CH_2OCOR)_3$, wherein n=2–18 and R=$CH_3$, $CH_2CH_3$, or $CH_2CH_2CH_3$. The composition may comprise about 1–100 wt % ester, remainder mineral oil. Other preferred compositions are about 50–99 wt % mineral oil and about 1–50 wt % ester; about 85–98 wt % mineral oil, and about 2–15 wt % ester; and about 92–97 wt % mineral oil, and about 3–8 wt % ester. A particularly preferred composition contains about 95 wt % mineral oil and about 5 wt % ester.

Triacetate esters of the trimethylolalkanes are preferred. Some suitable compounds are trimethylolbutane triacetate, trimethylolhexane triacetate, and trimethyloloctane triacetate. Trimethylolbutane triacetate is particularly preferred.

A metalworking lubricant emulsion is prepared by mixing about 95–99 wt % water with about 1–5 wt % of a composition comprising about 50–85 wt % mineral oil and about 15–50 wt % of the ester. The composition preferably comprises about 60–80 wt % mineral oil and about 20–40 wt % ester. The ester may be a triacetate, tripropionate, or tributyrate and is preferably a triacetate. Some particularly preferred esters are trimethylolbutane triacetate, trimethylolhexane triacetate, and trimethyloloctane triacetate. The emulsion is suitable for hot rolling and cold rolling of aluminum and aluminum alloy materials.

DESCRIPTION OF A PREFERRED EMBODIMENT

The lubricant composition and emulsion employed in the method of the present invention are specifically designed for use in either hot rolling or cold rolling of aluminum and aluminum alloys. The composition exhibits friction-modifying properties which may also be useful for metalworking operations performed on other ferrous and non-ferrous metals. Such operations include rolling, drawing and ironing, machining, and others.

The term "hot rolling" refers to rolling that takes place at a metal entry temperature of approximately 450°–1,000° F. (232°–538° C.) for aluminum alloys. Hot rolling is typically employed to reduce slabs of aluminum alloy material that are several inches thick into sheets having a thickness of about ⅛ inch.

The term "cold rolling" refers to rolling in which metal entry temperature may range from about ambient temperature to 450° F. (232° C.) for aluminum alloys. Metal entry temperature is ordinarily about ambient temperature. Cold rolling is typically used to reduce sheets of aluminum alloy material about ⅛ inch thick into lesser thicknesses.

The trimethylolalkane esters used in practicing the present invention are acetates, propionates, or butyrates of trimethylolalkanes. These polyols possess an unusual chemical structure in that all three hydroxyl groups are primary alcohols positioned at one end of the molecule. The polyols can be synthesized from aldehydes by crossed Cannizzaro reactions. A method for preparation of an analogous compound, methyltrimethylolmethane, is disclosed in Brubaker et al U.S. Pat. No. 2,292,926. All of the polyols are solids at room temperature. Their melting points range from 60°–102° C.

The polyols are converted to acetates by reaction with acetic anhydride in a pyridine solvent. In the group having the formula $CH_3(CH_2)_nC(CH_2OCOCH_3)_3$ wherein n=1–18, all of the n=1–7 esters are liquids at room temperature. When n=8 or more, the esters are all solids at room temperature. When n=8, the melting point is 32° C.; and when n=9, the melting point is 42° C.

The lubricant compositions of the present invention were tested for friction and wear properties in neat form and by adding 5 wt % of the esters to 95 wt % mineral oil. Crossed cylinder friction and wear tests were conducted with 5056-0 aluminum alloy samples. Results of these tests are shown in Table I.

TABLE I

Crossed Cylinder Friction and Wear Tests

| Compound Tested | Pure Compound Coefficient of Friction | Pure Compound Wear ($mm^2$) | 95 wt % Mineral Oil + 5 wt % Compound Coefficient of Friction | 95 wt % Mineral Oil + 5 wt % Compound Wear ($mm^2$) |
|---|---|---|---|---|
| (1) $CH_3CH_2C(CH_2OCOCH_3)_3$ | 0.126 | 7.50 | 0.067 | 0.77 |
| (2) $CH_3(CH_2)_2C(CH_2OCOCH_3)_3$ | 0.083 | 0.34 | 0.056 | 0.93 |
| (3) $CH_3(CH_2)_4C(CH_2OCOCH_3)_3$ | 0.080 | 0.24 | 0.043 | 1.02 |
| (4) $CH_3(CH_2)_5C(CH_2OCOCH_3)_3$ | 0.086 | 0.22 | 0.043 | 1.08 |
| (5) $CH_3(CH_2)_6C(CH_2OCOCH_3)_3$ | 0.082 | 0.21 | 0.041 | 0.95 |
| (6) $CH_3(CH_2)_8C(CH_2OCOCH_3)_3$ | 0.094 | 0.20 | 0.045 | 1.17 |
| (7) $CH_3(CH_2)_9C(CH_2OCOCH_3)_3$ | 0.111 | 0.32 | 0.051 | 1.26 |
| (8) $CH_3CH_2C(CH_2OCOC_7H_{15})_3$ (PRIOR ART) | 0.040 | 0.48 | 0.042 | 1.04 |
| (9) Oleic Acid (PRIOR ART) | 0.045 | 0.36 | 0.042 | 0.83 |
| (10) Methyl Laurate (PRIOR ART) | 0.049 | 1.50 | 0.044 | 1.63 |

No precise mechanism of action for the lubricant composition of the present invention has been postulated. However, the data reported in Table I show two interesting characteristics. First, the longest chain in trimethylolbutane triacetate is only 5 carbon atoms compared with 8 carbons in trimethylolpropane trioctanoate and 18 carbons in oleic acid. It is unusual for a compound like trimethylolbutane triacetate with such a short chain length to show equivalent or better wear properties than the two prior art compounds with longer chains. Second, the friction and wear test results in Table I do not show any consistent pattern of change from short chain compounds like trimethylolbutane triacetate to longer chain compounds like trimethyloldecane triacetate and trimethylolundecane triacetate. For example, by increasing chain length from $C_5$ (trimethylolbutane triacetate) to $C_{12}$ (trimethylolundecane triacetate), friction and wear properties remain essentially unchanged. Ordinarily, both friction and wear properties would be expected to improve with increasing chain length in the additives.

While the invention has been disclosed and described with reference to several examples, it is apparent that changes and modifications can be made therein. it is intended in the following claims to cover such variations and modifications as fall within the spirit and scope of the invention.

What is claimed is:

1. A metalworking lubricant composition comprising:

(a) about 50–99 wt % mineral oil, and (b) about 1–50 wt % of a trimethylolalkane ester having the formula $CH_3(CH_2)_nC(CH_2OCOR)_3$, wherein n=2–18 and R=$CH_3$, $CH_2CH_3$, or $CH_2CH_2CH_3$.

2. A metalworking lubricant as claimed in claim 1 wherein said composition comprises about 85–98 wt % mineral oil and about 2–15 wt % of the trimethylolalkane ester.

3. A metalworking lubricant as claimed in claim 1 wherein said composition comprises about 92–97 wt % mineral oil and about 3–8 wt % of the trimethylolalkane ester.

4. A metalworking lubricant as claimed in claim 1 wherein the ester is a triacetate and n=2–7.

5. A metalworking lubricant as claimed in claim 4 wherein said triacetate is selected from the group consisting of trimethylolbutane triacetate, trimethylolhexane triacetate, and trimethyloloctane triacetate.

6. A metalworking lubricant as claimed in claim 4 wherein said triacetate is trimethylolbutane triacetate.

7. A metalworking lubricant emulsion comprising about 1–5 wt % of the composition of claim 1 wherein the mineral oil comprises about 50–85 wt % of the composition and the ester comprises about 15–50 wt % of the composition, said emulsion further comprising:

(c) about 95–99 wt % water.

8. The emulsion of claim 7 wherein the mineral oil comprises about 60–80 wt % of the composition and the ester comprises about 20–40 wt % of the composition.

9. The emulsion of claim 7 wherein said ester is a triacetate and n=2–7.

10. The emulsion of claim 7 wherein said ester is selected from the group consisting of trimethylolbutane triacetate, trimethylolhexane triacetate, and trimethyloloctane triacetate.

11. A method of metalworking comprising the steps of:

(a) applying to a metal object a lubricant composition comprising a trimethylolalkane ester having the formula $CH_3(CH_2)_nC(CH_2OCOR)_3$, wherein n=2–18, and (b) performing a metalworking operation on the metal object.

12. A method of metalworking as claimed in claim 11 wherein said composition comprises about 1–100 wt % of the ester, remainder mineral oil.

13. A method of metalworking as claimed in claim 11 wherein said composition comprises about 85–98 wt % mineral oil and about 2–15 wt % of the ester.

14. A method of metalworking as claimed in claim 11 wherein said composition comprises about 92–97 wt % mineral oil and about 3–8 wt % of the ester.

15. A method of metalworking as claimed in claim 11 wherein said metal is aluminum or an aluminum alloy.

16. A method of metalworking as claimed in claim 11 wherein step (b) comprises hot rolling or cold rolling the metal obJect.

17. A method of metalworking as claimed in claim 11 wherein said ester is selected from the group consisting of trimethylolbutane triacetate, trimethylolhexane triacetate, and trimethyloloctane triacetate.

18. A method for hot rolling or cold rolling a metal object comprising aluminum or an aluminum alloy, said method comprising the steps of:

(a) applying to the metal object a lubricant emulsion comprising about 95–99 wt % water and about 1–5 wt % of a lubricant composition comprising about 50–85 wt % mineral oil and about 15–50 wt % of a trimethylolalkane ester having the formula $CH_3(CH_2)_nC(CH_2OCOR)_3$, wherein n=1–18 and R=$CH_3$, $CH_2CH_3$, or $CH_2CH_2CH_3$, and (b) hot rolling or cold rolling the metal object.

19. A method as claimed in claim 18 wherein the mineral oil comprises about 60–80 wt % of the composition and the ester comprises about 20–40 wt % of the composition.

20. A method as claimed in claim 18 wherein the ester is a triacetate and n=1–7.

* * * * *